US005359844A

United States Patent [19]

Schwalm

[11] Patent Number: 5,359,844

[45] Date of Patent: Nov. 1, 1994

[54] SLIVER CAN EXCHANGE APPARATUS WITH CAN TRANSPORT CARRIAGE HAVING A ROTATABLE PLATFORM WITH THREE CAN SUPPORTS

[75] Inventor: Hans-Werner Schwalm, Moenchengladbach, Germany

[73] Assignee: W. Schlafhorst AG & Co., Moenchengladbach, Germany

[21] Appl. No.: 922,816

[22] Filed: Jul. 31, 1992

[30] Foreign Application Priority Data

Jul. 31, 1991 [DE] Germany ..... 4125382

[51] Int. Cl.[5] ..... D01H 9/10; D01H 5/28

[52] U.S. Cl. ..... 57/281; 19/159 A; 57/90; 57/268; 57/270

[58] Field of Search ..... 57/90, 266, 268, 270, 57/281; 19/159 A

[56] References Cited

U.S. PATENT DOCUMENTS

| | | | |
|---|---|---|---|
| 4,150,534 | 4/1979 | Raasch | 19/159 A X |
| 4,735,040 | 4/1988 | Pircher | 57/90 X |
| 4,939,895 | 7/1990 | Raasch et al. | 57/90 X |
| 4,998,406 | 3/1991 | Raasch | 57/281 |
| 5,138,828 | 8/1992 | Stahlecker | 57/90 X |
| 5,158,417 | 10/1992 | Siegenthaler et al. | 57/281 X |

FOREIGN PATENT DOCUMENTS

3505496A1 8/1986 Germany .

*Primary Examiner*—Daniel P. Stodola
*Assistant Examiner*—William Stryjewski
*Attorney, Agent, or Firm*—Shefte, Pinckney & Sawyer

[57] ABSTRACT

An apparatus for transporting full sliver cans to the spinning stations of a textile spinning machine for can exchange operations thereat during which empty sliver cans are exchanged for full sliver cans. The apparatus includes a can transport carriage having three can supports at equal angular spacings from one another relative to a vertical axis and a device for indexing movement of the three can supports to sequentially position each can support at a can transfer location at which a can is transferred between the can transport carriage and the textile spinning machine. Each can support is sequentially indexed to a standby location from the can transfer location and, thereafter, to a ready location from which the can support is indexed into the can transfer location. The can transfer and ready locations are arranged such that two sliver cans supported at these locations are substantially aligned in the direction of travel of the can transport carriage. Also, the three can supports are dimensioned such that the outward lateral extent thereof is generally within the outward lateral extent of the two sliver cans supported at the can transfer and ready locations.

10 Claims, 6 Drawing Sheets

SLIVER CAN EXCHANGE APPARATUS WITH CAN TRANSPORT CARRIAGE HAVING A ROTATABLE PLATFORM WITH THREE CAN SUPPORTS

BACKGROUND OF THE INVENTION

The present invention relates to a sliver can transport carriage for automatic sliver can exchange operations and, more particularly, to a sliver can transport carriage for supplying full sliver cans to the spinning stations of a spinning machine and transporting empty sliver cans from the spinning stations.

U.S. Pat. No. 4,998,406 to Raasch discloses a sliver can transport carriage having a rotating table for supporting thereon a plurality of sliver cans in respective can supports. The can transport carriage transports a plurality of full sliver cans to a transfer position adjacent the spinning station of a spinning machine and the table rotates to sequentially bring each full sliver can supported on the can transport carriage into position for subsequent transfer to the spinning station. The can transport carriage receives empty sliver cans from the spinning station for subsequent transport of these empty sliver cans to a sliver can refill location.

The rotating table of the above-noted prior art sliver can transport carriage supports four sliver cans thereon at equal radial spacing from the table rotation axis and, by virtue of this geometry, the width of the can transport carriage is substantial and requires a correspondingly wide open area adjacent the spinning machine for travel of the can transport carriage thereadjacent.

German Offenlegungsschrift DE 35 05 496 A1 also discloses a can transport carriage for transporting sliver cans to and from the spinning stations of a textile spinning machine. The transported sliver cans are aligned in a single row during transport thereof. Accordingly, there is still a need for improvement in a sliver can transport carriage which provides the load economizing capability to transport sliver cans in more than a single row while avoiding the need for relatively large open areas adjacent a spinning machine to accommodate a relatively wide transport carriage.

SUMMARY OF THE INVENTION

Briefly described, the present invention provides an apparatus for transporting full sliver cans to the spinning stations of a textile spinning machine for exchange of full silver cans for empty sliver cans at the spinning stations. The apparatus includes a can transport carriage movable to and between the spinning stations, the can transport carriage including means forming three can supports each for supporting a sliver can thereon. The can transport carriage includes means for indexing movement of the can supports to sequentially position each can support at a can transfer location at which a can is transferred between the can support and the textile spinning machine during a can exchange operation, a standby location, and a ready location from which the respective can support thereat is indexed into the can transfer location. Additionally, the can transfer location and the ready location are arranged such that two sliver cans supported at these two locations are substantially aligned in the direction of travel of the can transport carriage and the can supports forming means are dimensioned such that the outward lateral extent thereof is generally within the outward lateral extent of the two sliver cans at the can transfer and ready locations.

In one feature of the apparatus for transporting full sliver cans, the transport carriage has a centerline and the can supports forming means extends to generally the same outward lateral extent in opposite lateral directions relative to the centerline in the disposition of the can supports forming means in which each can support is positioned at a respective one of the can transfer, ready, and standby location.

In another feature of the apparatus for transporting full sliver cans, the three can supports are at equal angular spacings of 120° from one another relative to an axis transverse to the direction of travel of the can transport carriage and its lateral extent. According to further details of this another feature, the circumferential positions of the sliver cans at the can supports define an equilateral triangle each side of which is tangential to the circumferential positions of two of the sliver cans with the circumferential positions of any two sliver cans generally aligned in the travel direction being tangential to the same respective side of the triangle, the perpendicular bisectors of the sides of the equilateral triangle mutually intersecting one another at an intersection point interiorly of the equilateral triangle. Also, the lateral extent of the means forming the can supports is substantially equal to twice the length of a segment of one of the perpendicular bisectors as measured between the respective side defining the one perpendicular bisector and the intersection point.

In yet a further feature of the apparatus for transporting full sliver cans, there is provided a can manipulating assembly having a selectively extendable and retractable frame and a pair of gripping elements mounted to the frame for gripping a sliver can, at least one of the gripping elements being movable between a can gripping position in which it cooperates with the other gripping element to grip a sliver can and a can release position in which it cooperates with the other gripping element to release a gripped sliver can, the frame being extendable in a direction generally transverse to the direction of travel of the can transport carriage to position the gripping elements laterally outwardly of one side of the transport carriage for selective release or gripping of a sliver can. According to further details of the further feature, each sliver can includes a body portion and an upper circumferential bead of a greater radius than the body portion of the sliver can and the can manipulating assembly includes means for moving the gripping elements to respective circumferentially spaced positions radially inwardly of and below the upper bead of a sliver can. Also, the can manipulating assembly includes a plurality of centering elements mounted to the frame and positioned at respective circumferential spacings from one another relative to a circle generally concentric with a sliver can to be gripped for axially centering a gripped sliver can as it is lifted by the gripping elements.

According to additional details of the further feature, the can manipulating assembly includes means for extending the frame from a position in which the gripping elements are operable to release a sliver can onto the respective can support disposed at the can transfer location lying at a predetermined angular position relative to the direction of travel to a position laterally outward of the transport carriage for gripping a silver can to be transferred to the transport carriage.

According to yet another additional feature of the apparatus for transporting full sliver cans, each spinning station includes means for signaling information relating to the filled status of sliver cans from which sliver is drawn into the spinning stations and the can transport carriage includes means for controlling the can transport carriage to travel to a selected spinning station in response to a signal from the information signalling means indicating the need for a sliver can exchange operation at the selected spinning station.

According to yet a further additional feature of the apparatus for transporting full sliver cans, the can manipulating assembly includes means for extending the frame laterally outwardly of the transport carriage on a side thereof opposite the one side to a position in which the gripping elements are operable to selectively grip a sliver can supported at a sliver can loading location or releasing of a gripped sliver can onto the sliver can loading location and for retraction of the frame to a position in which the gripping elements are operable to selectively grip a sliver can supported on a can support or to release a sliver can onto a can support. Also, the can manipulating assembly is preferably movable between a spinning station and the sliver can loading location.

DESCRIPTION OF THE PREFERRED EMBODIMENT

Figure 1:
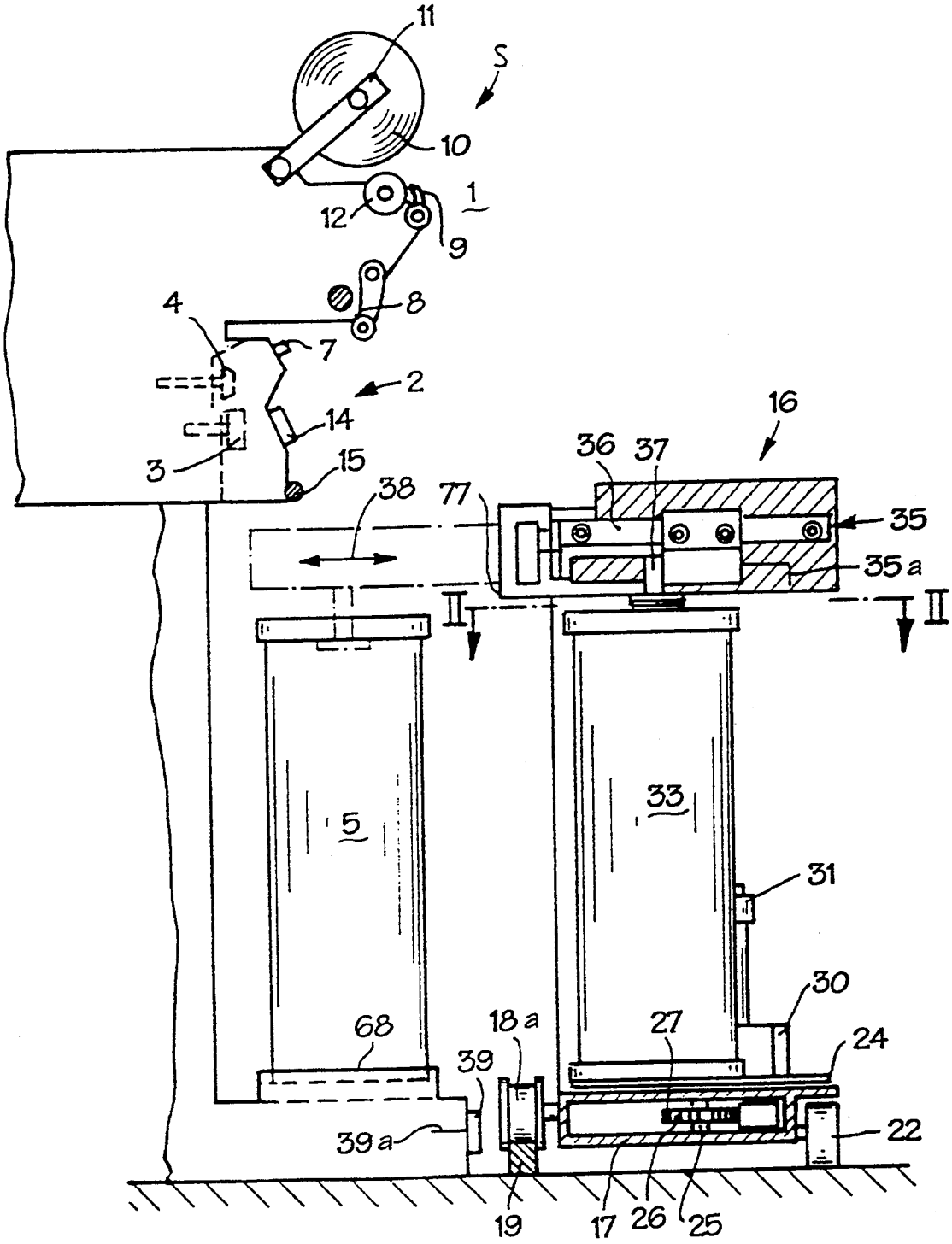
FIG. 1 is a side elevational view of a spinning station of a textile spinning machine and, in partial vertical section, of the preferred embodiment of the sliver can transport carriage of the present invention in its operating position adjacent the spinning station.

As seen in FIGS. 1–4, 5*a–b*, 6, and 7*a–f*, the preferred embodiment of the sliver can transport carriage 16 of the present invention is operable to supply full sliver cans to a textile spinning machine such as, for example, an open end spinning machine S having a plurality of spinning stations 1. As seen in FIG. 1, each spinning station 1 of the open end spinning station S includes a spinning box 2 having an opening device 3 and a rotor 4. The spinning box 2 draws in sliver from a sliver can, such as a sliver can 5 positioned below the spinning box 2. So long as the spinning box 2 is able to draw sliver from a sliver can, the rotor 4 operates to form the sliver fibers into a strand which is continuously drawn out of the spinning box 2 through a navel 7 and sequentially traveled through a pair of draw-off rolls 8 and a yarn guide 9 onto a cross-wound package 10 rotatably supported on a cross-wound package frame 11 and rotatably driven by a friction drive roller 12. However, upon emptying of the respective sliver can feeding the spinning box 2, the drawing of a strand from the spinning box correspondingly ceases as slivers no longer available to be formed into the strand and the cross-wound package 10 is disengaged from the driving movement of the friction drive roller 12 until the spinning operation is restarted.

Figure 4:
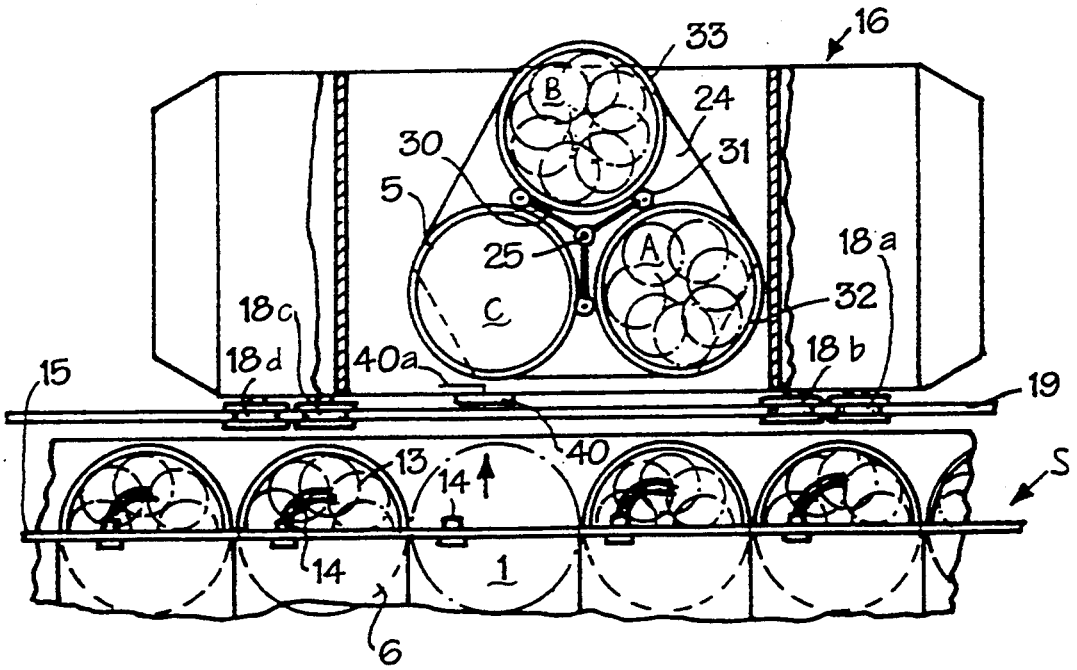
FIG. 4 is a top plan view, in partial horizontal section, of the sliver can transport carriage shown in FIG. 1 disposed in its operational position for receiving an empty sliver can from a spinning station of a textile spinning machine, taken along lines IV—IV of FIG. 3.

As seen in FIG. 4 in a typical spinning machine sliver feeding arrangement, a plurality of sliver cans 6 are disposed under the spinning boxes 2 and the sliver drawn out of each sliver can 6 initially passes through a compressive intake assembly 14 supported on a shaft 15. The sliver can transport carriage 16 is operable to travel to and between the spinning stations 1 to supply full sliver cans 5 thereto upon exhaustion of the sliver cans 6 already positioned at the spinning stations and to transport the exhausted or empty sliver cans 6 to another locations such as, for example, a location at which the sliver cans are refilled with sliver (not shown).

Figure 2:
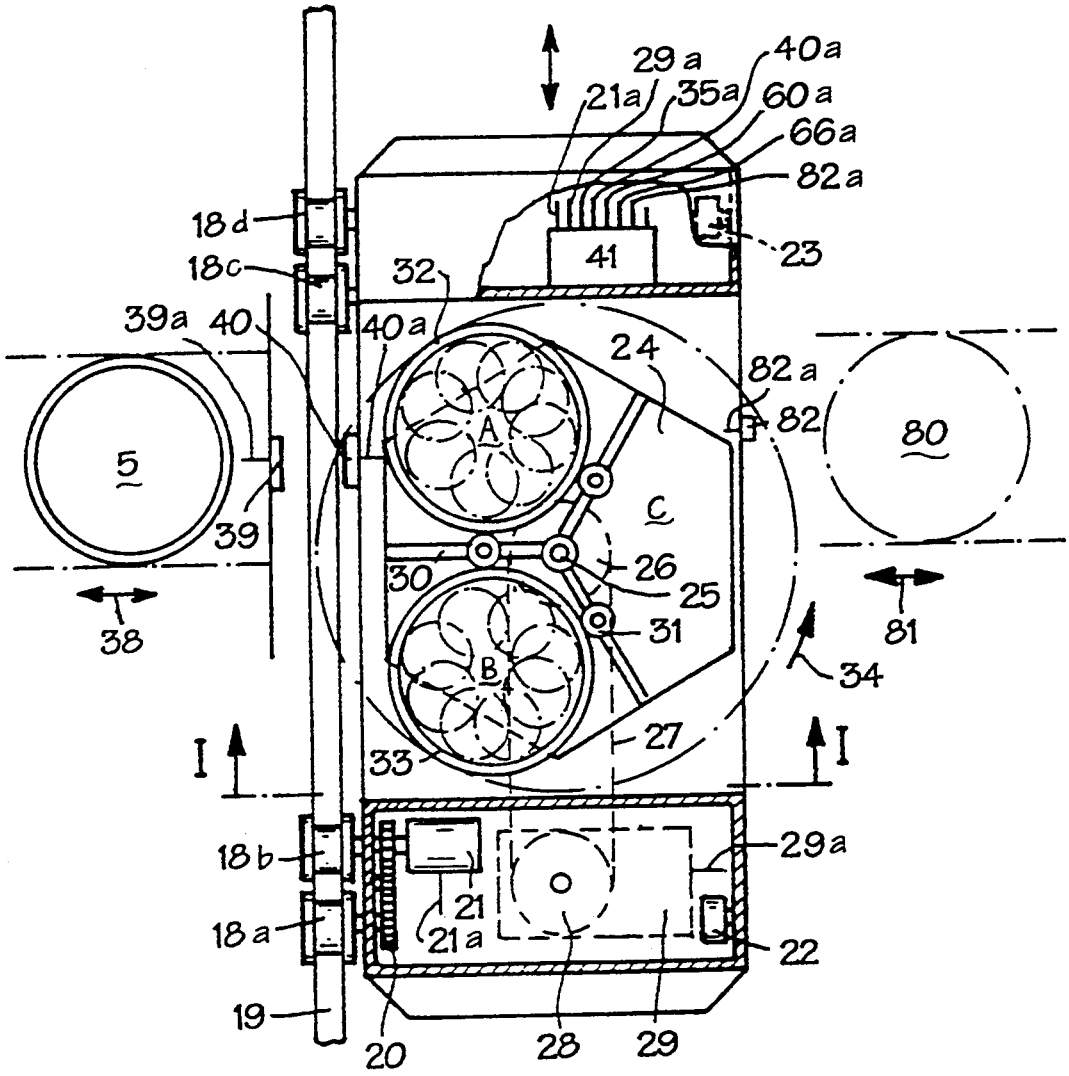
FIG. 2 is a top plan view, in partial horizontal section, of the sliver can transport carriage shown in FIG. 1.

As seen in FIG. 1, the sliver can transport carriage 16 includes an undercarriage frame 17, one side of which rotatably supports a first pair of flanged wheels 18*a*,18*b* and a second pair of flanged wheels 18*c*,18*d* at a longitudinal spacing from the first pair of flanged wheels. As seen in FIG. 2, the two pairs of flanged wheels 18*a*,18*b* and 18*c*,18*d* are rotatably supported on the undercarriage frame 17 for rolling travel of the wheels along a guide rail 19 extending longitudinally along the lengthwise extent of the open end spinning machine S. The undercarriage frame 17 also rotatably supports a pair of smooth-surfaced wheels 22,23 for rolling support of the sliver can transport carriage 16 along a floor in cooperation with the guided rolling support of the flanged wheels 18*a–d* extending from the other side of the undercarriage frame 17. A drive motor 21, as seen in FIG. 2, is operatively connected via a connector 21*a* to a control unit 41 mounted on the sliver can transport carriage 16 and the drive motor 21 is operatively connected via a transmission assembly 20 to the flanged wheels 18*a*,18*b* for driving movement of the sliver can transport carriage.

As seen in FIG. 2, the sliver can transport carriage 16 includes means for supporting up to three sliver cans for simultaneous movement thereof about a vertical axis extending transversely to the longitudinal and lateral extents of the sliver can transport carriage 16. The supporting means is preferably in the form of a six-sided turntable 24 rotatably supported on a shaft 25 defining the vertical axis and the shaft 25 is co-axially mounted to a gear 26, as seen in FIG. 2. A drive gear 28 is driveably connected to the gear 26 by a drive chain 27 for driving rotation of the turntable 24 in correspondence with the rotation of the drive gear 28 by a drive motor 29, which is operatively connected via a connector 29*a* to the control unit 41.

The turntable 24 includes three supports A, B, and C at equal radial spacings with respect to the shaft 25. Each support A, B, and C supports a sliver can. Each support A, B, and C is adjoined by the other two respective supports and shares with each adjoining support one of three common wall segments 30 extending radially from the shaft 25 at 120° angular spacings from one another. An impact roller 31 is rotatably supported on a vertical axis on each of the common wall segments 30 for cooperating with another one of the impact rollers to precisely position a sliver can disposed on their respective support. The impact rollers 31 are disposed at a height relative to the sliver cans supported on the can supports such that the impact rollers do not undesirably operate as fulcrums about which the sliver cans may tilt or otherwise behave in an unstable manner during rotation of the turntable 24.

As seen in FIG. 2, the turntable 24 has a particular geometric shape selected to minimize the lateral extent of the turntable during transport of sliver cans by the sliver can transport carriage 16. The circumferential positions of the three sliver cans supported on the can supports A, B, and C define an equilateral triangle, each side of which is tangential to the circumferential positions of two of the sliver cans (e.g., the circle defined by each sliver can when disposed in a can support). Each side of the equilateral triangle defines a perpendicular bisector and each of the common wall segments 30 lies on the perpendicular bi-sector of a respective side of the equilateral triangle. The perpendicular bi-sectors of the sides of the equilateral triangle mutually intersect at an intersection point coincident with the axis of the shaft 25. The lateral extent of the turntable 24 transverse to the travel direction of the sliver can transport carriage longitudinally along the spinning machine is equal to twice the length of a segment (e.g., a common wall segment 30) of one of the perpendicular bi-sectors as measured between the respective triangle side defining the one perpendicular bi-sector and the intersection point coincident with the axis of the shaft 25.

Three sides of the turntable 24 define the equilateral triangle tangential to the circumferential positions of the sliver cans supported on the can parking spaces A, B, and C. The other three sides of the turntable 24 each lie on a line truncating a respective corner of the equilateral triangle such that each sliver can supported on a can support A, B, and C extends radially further from the axis of the shaft 25 any side of the turntable 24.

As seen in FIG. 2, the particular geometric shape the turntable 24 insures that no portion of the turntable exceeds the outward radial extent of the circumferential positions of the sliver cans relative to the axis of the shaft 25. Moreover, the particular geometric shape of the turntable 24 insures that the turntable can be rotated to a position in which it occupies a relatively narrow extent as measured in a width direction transverse to its direction of travel indicated by the double arrows in FIG. 2 to thereby permit the sliver can transport carriage 16 (and, in particular, its underside frame 17) to be constructed of a relative narrow widthwise extent. To that end, as illustrated in the drawings, the turntable 24 includes dies 90 extending between can supports A, B, and C and ends 92 extending between the sides 90. To achieve the desired narrowness, the sides 90 are disposed at lateral extent of the turntable 24 which is no greater than the edges of the sliver cans which may be disposed at the can supports A and B. While the axis of the rotation 254 or the turntable 24 may be coincident with the carriage centerline, but such symmetry is not a requirement. Due to specific carriage construction requirements, the axis of rotation 25 of the turntable 24 may be offset slightly from the centerline of the carriage without affecting the performance of the present invention and without altering the basic turntable 24 structure. As illustrated, the ends 92 extend laterally from approximately the carriage centerline at can support C no greater than an opposite lateral extend of the side 90 that extends between the cans at can supports A and B. According to the preferred embodiment of the present invention, the turntable is formed as a hexagon, however, it is to be understood that other geometric shapes may be employed for the turntable with equal success in achieving the desired narrowness.

Figure 3:
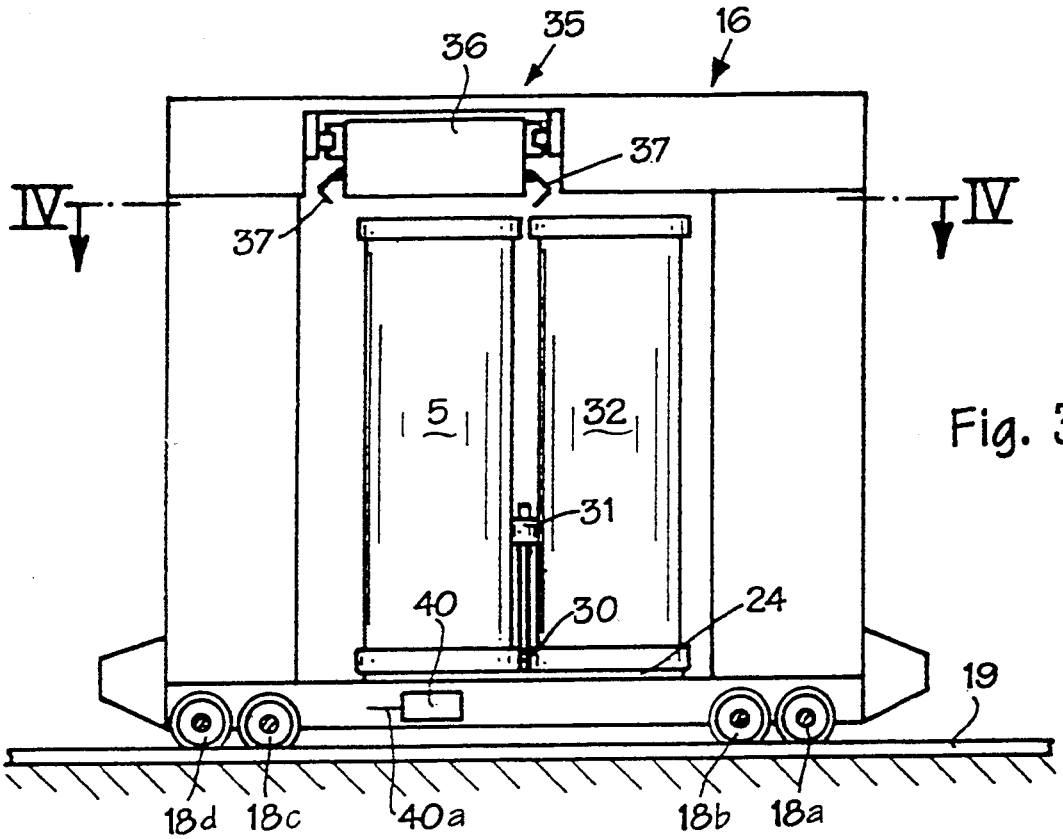
FIG. 3 is a front elevational view of the sliver can transport carriage shown in FIG. 1.

With further regard to the other components of the sliver can transport carriage 16, as seen in FIG. 3, the transport carriage includes a can manipulating assembly 35 for loading and unloading sliver cans between the can supports A, B, and C and a spinning station 1 or another sliver can parking location. The can manipulating assembly 35 includes a telescoping frame 36 having a pair of can grasping arms 37 for selectively grasping and releasing a sliver can. The telescoping frame 36 is normally in a retracted position in which the can grasping arms 37 are disposed diametrically opposite one another relative to a vertical transfer axis which is coincident with the axis of a sliver can supported by the turntable 24 at a can transfer location. As seen in FIGS. 2 and 3, the can transfer position is the position occupied by a sliver can supported by the respective can support at the particular rotational disposition of the turntable 24 shown in FIG. 2 (e.g., the can support A). The telescoping frame 36 is movable horizontally in a forward or reverse manipulating direction (indicated by the double arrow 38 in FIG. 2) transverse to the direction of travel of the sliver can transport carriage 16. As seen in particular in FIGS. 5*a* and 5*b*, each can grasping arm 37 includes a rigid claw member 58 having an in-turned end for positioning under an upper bead 73 of a sliver can 74 to support the sliver can in cooperation with the in-turned end of the rigid claw member 58 of the other can grasping arm 37. The other end of each claw member 58 is fixedly mounted to one end of a link. The same end of the link is pivotedly mounted to the free end of a piston of a piston and cylinder assembly 67 which is pivotedly mounted to the telescoping frame 36.

The other end of the link is pivotedly mounted to one leg 63 of a bell crank 59, which is pivotedly mounted by a pivot 64 to the telescoping frame 36. The other leg of each bell crank 59 is pivotedly mounted to the free end of a piston 61 of a piston and cylinder 60 which is fixedly mounted to the telescoping frame 36. The pair of piston and cylinder assemblies 60 are connected via connectors 60*a* to the control unit 41, as seen in FIG. 2. A limit switch 66 is disposed adjacent the travel path of the one leg 63 of each of the bell cranks 59 and is connected via connector 66*a* to the control unit 41 for indicating the arrival of the one leg 63 of the bell crank at the end of its travel during pivoting travel of the bell crank in a selected pivoting direction.

Figure 5A:
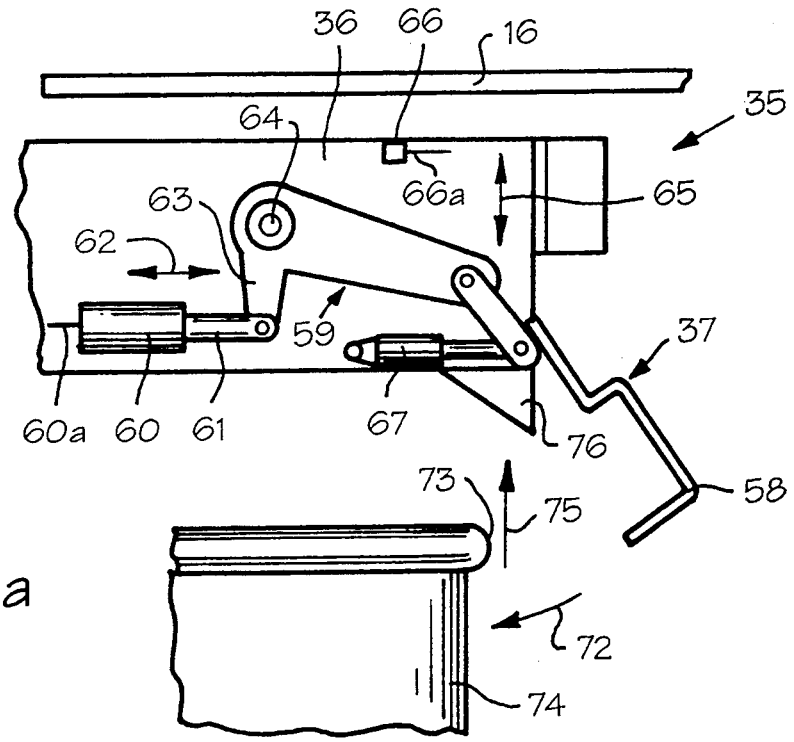
FIG. 5*a* is an enlarged front elevational view of the sliver can transport carriage shown in FIG. 3 and showing a portion of the sliver can gripping assembly thereof in a non-gripping position.

As seen in FIG. 5*a*, the piston 61 of each of the piston and cylinder assemblies 60 is selectively extendable and retractable in the directions indicated by the double arrow 62 to effect pivoting of the respective bell crank 59 about its pivot 64. Also, each cylinder and piston assembly 67, which may include, for example, a gas pressurized spring, continuously biases the respective claw member 58 in a laterally outward disposition in which the in-turned end of the claw member is disposed laterally outwardly of the circumference of the upper bead 73 of a sliver can 74 positioned under the can manipulating assembly 35.

In operation, when the sliver can transport carriage 16 is parked adjacent a spinning station 1 or other location for performing a sliver can exchange operation thereat, the telescoping frame 36, which is normally in its retracted position during the travel of the sliver can transport carriage, is either maintained in its retracted position (for grasping a sliver can supported on the rotating turntable 24) or is extended to a position over a sliver can at the spinning station or other location for supplement grasping of the sliver can. The extending and retracting movement of the telescoping frame 36 is controlled by the control unit 41. If, for example, an empty sliver can 5 is to be transferred from a spinning station 1 to an unoccupied can support on the rotating turntable 24, the telescoping frame 36 is controlled by the control unit 41 to extend to a position in which the telescoping frame is disposed over the empty sliver can 5 with the claw members 58 of the pair of the can grasping arms 37 disposed laterally outwardly and above the empty sliver can 5. The control unit 41 then controls the pair of the cylinder and piston assemblies 60 to extend their respective pistons 61 to thereby effect pivoting of the one leg 63 of each bell crank 59 in a pivot direction such as, for example, the pivot direction indicated by the arrow 71 in FIG. 5*b* in which the one leg 63 of the bell crank pivots into contact with the limit switch 66. The pivoting movement of the legs 63 of each respective bell crank 59 effects both laterally inward and upward movement of the respective claw member 58 due to the linkage arrangement interconnecting the one leg 63 and the claw member 58 and the action of the respective cylinder and piston assembly 67. Accordingly, each of the claw members 58 initially moves laterally inward into contact with the circumference of the sliver can below its upper bead and, thereafter, moves upwardly into engagement with the upper bead to thereby lift the sliver can as well during continued pivoting of the respective bell crank 59.

Figure 6:
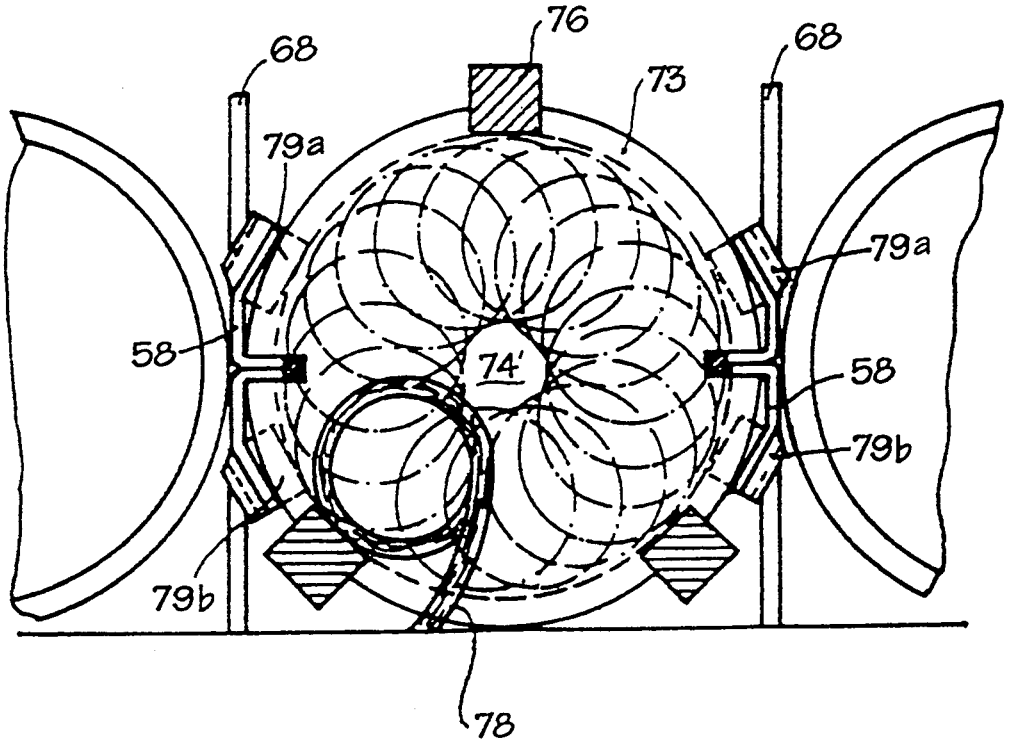
FIG. 6 is a top plan view, in partial horizontal section, of the sliver can gripping assembly shown in FIGS. 5*a* and 5*b;*

As seen in FIG. 6, each of the claw members 58 includes a pair of grip fingers 79*a*,79*b* which engage the underside of the upper bead 73 of a sliver can at circumferentially spaced locations thereon to insure stable grasping of the sliver can by the can manipulating assembly 35.

In correspondence with the positioning of the fingers 79*a*,79*b* of the pair of the claw members 58 under the upper bead 73 of the empty sliver can, the control unit 41, which has received a signal from the limit switches 66 indicating the completion of the positioning of the claw members 58, controls the telescoping frame 36 to retract with the now engaged empty sliver can has been moved therewith.

Figure 5B:
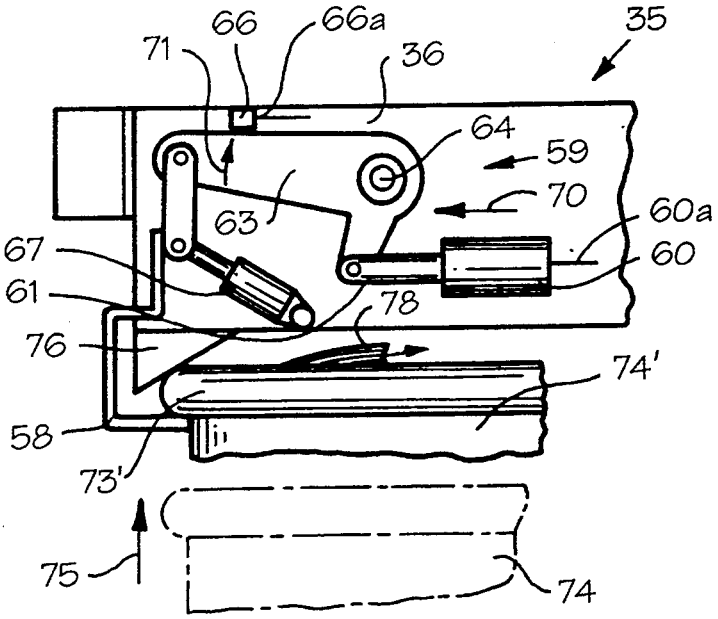
FIG. 5*b* is an enlarged front elevational view of a portion of the sliver can transport carriage shown in FIG. 3 and showing another portion of the sliver can gripping assembly shown in FIG. 5*a* in a can grasping position.

As seen in FIG. 5*b*, the respective sliver can 74 engaged by the claw members 58 is lifted upwardly in the direction indicated by the arrow 75 due to the upward movement of the claw members 58. As seen in FIGS. 5*a*, 5*b*, and 6, a plurality of centering components 76 are secured to the underside of the telescoping frame 36 and have inwardly tapering surfaces tapering in an upper direction for engaging the upper bead 73 of a sliver can as it is lifted by the claw members 58 to effect centering of the engaged sliver can relative to a transfer axis. This centering of the sliver can facilitates the disposing of the sliver can in a centered position on a respective can support on the turntable 24. The centering components 76 advantageously center a sliver can engaged by the can manipulating assembly 35 without disturbing any sliver which is, at the same time, being drawn from the sliver can, such as a sliver 78 as seen in FIG. 5*b*. The centering components are positioned at positions offset 120° from one another.

To insure that the telescoping frame 36 is extended or retracted at a sufficient clearance above any sliver can supported therebelow, the lower front edge 77 of the telescoping frame 36, as seen in FIG. 1, is appropriately constructed to minimize any damage or clamping of sliver with which the edge may come into contact. As seen in FIG. 5*b*, the centering components 76, the claw members 58, and the underside of the telescoping frame 36, are all configured to permit sufficient clearance between the underside of the telescoping frame 36 for a sliver to be drawn out of an engaged sliver can without interference.

As seen in FIG. 2, the telescoping frame 36 can be configured to extend to an opposite lateral side of the transport carriage 16 to grip a sliver can supported at an auxiliary sliver can loading position 80 or to release a sliver can thereonto. In coordination with the gripping or release of a sliver can at the auxiliary sliver can loading position 80 by the can manipulating assembly 35, the control unit 41 controls the rotation of the turntable 24 to position an empty can support at an appropriate angular disposition for receiving a sliver can laterally moved by the can manipulating assembly 35 from the auxiliary sliver can loading position 80 toward the transport carriage 16 or for supporting a full sliver can for subsequent lateral movement to the auxiliary sliver can loading position 80. A transceiver 82 is mounted on the opposite lateral side of the transport carriage 16 and is connected via connector 82*a* to the control unit 41 for providing signals indicating the alignment of the transport carriage 16 at a cam transfer disposition adjacent the auxiliary sliver can loading position 80.

A transmitter 39 is mounted at each spinning station 1 and is connected via connection 39' to a spinning machine control unit (not shown). The transmitter 39 is configured to emit a signal having a supply demand component and alignment component. The sliver can transport carriage 16 includes a receiver 40 mounted on the underside frame 17, as seen in FIGS. 2 and 3, at the same height as the transmitters 39 mounted at the spinning stations 1 and the receiver 40 is connected via a connector 40*a* to the control unit 41. The receiver 40 is operable to receive the signals emitted by the transmitters 39 of those spinning stations 1 at which a sliver can exchange operation is currently due or will be due within a relatively short period of time. The signal received by the receiver 40 is further transmitted to the control unit 41, which controls the drive motor 21 via the connector 21*a* to drive the sliver can transport carriage 16 to each respective spinning station 1 emitting a signal. Through appropriate known signal transmitting and receiving operations between the transmitters 39 and the receiver 40, a signal is transmitted to the control unit 41 indicating that the sliver can transport carriage 16 and the respective spinning station 1 at which a sliver can exchange operation is to be performed are aligned with one another.

Figures 7A, 7B, 7C, 7D, 7E, 7F:
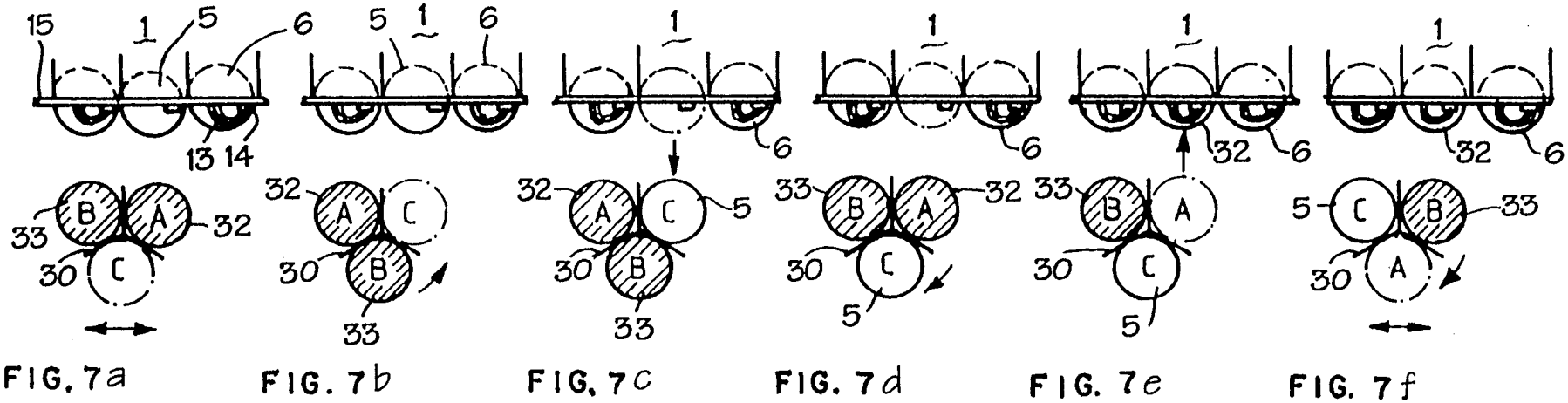
FIG. 7*a* is a schematic top plan view of the sliver can transport carriage shown in FIG. 1 during travel thereof along a textile spinning machine.
FIG. 7*b* is schematic top plan view of the sliver can transport carriage in a transfer position adjacent a spinning station of a textile spinning machine during its empty support presenting operation.
FIG. 7*c* is a schematic top plan view of the sliver can transport carriage during its receipt of an empty sliver can from a spinning station.
FIG. 7*d* is a schematic top plan view of the sliver can transport carriage during its travel readying operation.
FIG. 7*e* is a schematic top plan view of the sliver can transport carriage during a full sliver can transfer operation in which a full sliver can is transferred to a spinning station.
FIG. 7*f* is a schematic top plan view of the sliver can transport carriage during its full sliver can shuffle operation in which a full sliver can is indexed into a can transfer position for subsequent transfer therefrom to a spinning station.

In FIG. 7, an exemplary operational sequence of the sliver can transport carriage 16 is illustrated in which the transport carriage is operated to supply a pair of full sliver cans 32,33 to the spinning stations 1 of the open end spinning machine S. As seen in FIG. 7*a*, the sliver can transport carriage 16, which is schematically represented by the common wall segments 30, travels longitudinally along one side of the open end spinning machine S, as indicated by the double arrows in FIG. 7*a*, with the two full sliver cans 32,33 being supported on the can supports A,B, respectively, of the rotating turntable 24 and the can support C being initially empty. The telescoping frame 36 of the can manipulating assembly 35 is in its retracted position and its can grasping arms 37 are disposed above and laterally outward of the can supported at the can support A (e.g., the full sliver can 32). The full sliver cans 32,33 are aligned one behind the other relative to the direction of travel of the sliver can transport carriage 16.

As seen in FIG. 7*b*, the control unit 41, in response to the receipt of a signal from the receiver 40 on the transport carriage indicating that the sliver can transport carriage is aligned with the respective spinning station of the open end spinning machine S, controls the drive motor 21 to halt the transport carriage at a transfer position adjacent the respective spinning station 1 at which an empty sliver can 5 is to be exchanged for one of the full sliver cans 32,33. Also, the control unit 41 controls the turntable 24 to pivot about the axis of its shaft 25 in a counterclockwise direction through 120° to thereby bring the empty can support C into the can transfer position at which an empty sliver can 5 from the respective spinning station 1 can be transferred by the can manipulating assembly 35 to the empty can support C.

As seen in FIG. 7*c*, the empty sliver can 5 at the respective spinning station 1 is transferred to the empty can support C by a can manipulating operation performed by the can manipulating assemblies 35 in which, as described in particular with respect to FIGS. 5*a*, 5*b*, and 6, the can grasping arms 37 extend to, engage, and lift the empty sliver can 5 and retain the empty sliver can in its lifted position during retraction of the telescoping frame 36 to thereby effect transfer of the empty sliver can from the spinning station to the sliver can transport carriage.

As seen in FIG. 7*b*, in correspondence with the completion of the transfer of the empty sliver can 5 into the can support C by the can manipulating element 35, the control unit 41 controls the drive motor 29 to pivot the turntable 24 through a range of movement of 120°. Upon completion of this movement, the full sliver cans 32,33 are again aligned parallel to the direction of travel of the sliver can transport carriage 16. As seen in FIG. 7*e*, in correspondence with the completion of movement of the turntable 24, the can manipulating assembly 35 is operated to transfer the full sliver can 32, which is now positioned in the can transfer position adjacent the spinning station 1, to the spinning station. In correspondence with the transfer of the full sliver can 32 into the spinning station 1, an end of the sliver in the full sliver can is introduced into the respective spinning box 2 of the spinning station.

As seen in FIG. 7*f*, in correspondence with the completion of the transfer of the full sliver can 32 to the spinning station 1, the sliver can transport carriage 16 is again moved along the side of the open end spinning machine S to supply the full sliver can 33 to another spinning station 1. If desired, prior to such further traveling movement of the sliver can transport carriage 16, the turntable 24 can be controlled to pivot through a range of 120° to thereby bring the full sliver can 33 into the can transfer position. If this pre-travel positioning of the full sliver can 33 is undertaken, the full sliver can 33 supported on the can support B and the empty sliver can 5 supported on the can support C will be aligned one behind the other on a line parallel to the direction of travel of the transport carriage and neither sliver can will extend laterally outwardly of the transport carriage.

The full sliver can 33 is subsequently exchanged for an empty sliver can at another spinning station 1, whereupon the sliver can transport carriage 16 now supports two empty sliver cans in the can supports B and C with the can support A being empty. Since the sliver can transport carriage 16 no longer has any full sliver cans with which to perform a sliver can exchange operation, the transport carriage can be directed to another location such as, for example, a sliver can refill location, at which the empty sliver cans on the transport carriage can be exchanged for full sliver cans to be supplied to the spinning stations 1.

Although the sliver can transport carriage 16 has been described with respect to a configuration in which sliver cans transported by the sliver carriage are loaded and unloaded on one side of the transport carriage, the present invention also contemplates, as seen in FIG. 2, that the sliver can transport carriage 16 can be configured as desired to load and unload sliver cans at the opposite lateral side of the transport carriage. For example, a sliver can positioned at a transfer position 80 can be loaded at the opposite lateral side of the sliver can transport carriage 16 into the selected one of the can supports A, B, and C disposed at the respective can transfer position associated with the opposite lateral side of the transport carriage or, alternatively, a sliver can positioned at the can transfer position on the opposite lateral side of the transport carriage can be transferred to the sliver can position 80. Additionally, if desired, the sliver can transport carriage 16 can be configured to selectively load or unload sliver cans at either one of the lateral sides of the transport carriage. In this situation, the transport carriage is preferably provided with an additional receiver 82 mounted on the underside frame 17 and connected via connector 82*a* to the control unit 41 for cooperating with the transmitters 39 disposed along the side of the respective spinning machine between which sliver cans are to be exchanged at the opposite lateral side of the transport carriage.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for transporting full sliver cans to the spinning stations of a textile spinning machine for exchange of full sliver cans for empty sliver cans at the spinning stations, comprising:

a can transport carriage movable to and between the spinning stations, the can transport carriage including means forming three can supports each for supporting a sliver can thereon, said three can supports being disposed on a rotatable platform at generally equal angular spacings from one another relative to the axis of rotation of said platform and means for indexing movement of the can supports to sequentially position each can support at a can transfer location at which a can is transferred between the can support and the textile spinning machine during a can exchange operation, a standby location, and a ready location from which the respective can support thereat is indexed into the can transfer location, the can transfer location and the ready location being arranged such that two sliver cans supported at these two locations are substantially aligned in the direction of travel of the can transport carriage and the can supports forming means being dimensioned such that an outward lateral extent thereof at said can transfer and ready locations in generally no greater than an outward radial extent of the two sliver cans at said can transfer and ready locations, the sliver cans being generally cylindrical and include a circumferential edge, said can support forming means having sides extending between can support locations at a lateral extent when adjacent can supports are at said can transfer and ready locations which is no greater than the radial extent of the edges of the cans at said can transfer and ready locations, and having ends connecting said sides at each can support, with said ends extending laterally from said axis of rotation at said standby location no greater than an opposite lateral extent of the side that extends between said can transfer and ready locations.

2. Apparatus for transporting full sliver cans according to claim 1 wherein the transport carriage has a centerline extending in the direction of carriage travel through the longitudinal center of the carriage, and the can supports forming means extends to generally the same outward lateral extent in opposite lateral directions relative to the centerline in the disposition of the can supports forming means in which can supports are positioned at can transfer, ready, and standby locations.

3. Apparatus for transporting full sliver cans according to claim 1 and further comprising a can manipulating assembly having a selectively extendable and retractable frame and a pair of gripping elements mounted to the frame for gripping a sliver can, at least one of the gripping elements being movable between a can gripping position in which it cooperates with the other gripping element to grip a sliver can and a can release position in which it cooperates with the other gripping element to release a gripped sliver can, the frame being extendable in a direction generally transverse to the direction of travel of the can transport carriage to position the gripping elements laterally outwardly of one side of the transport carriage for selective release or gripping of a sliver can.

4. Apparatus for transporting full sliver cans according to claim 3 wherein each sliver can includes a body portion and an upper circumferential bead of a greater radius than the body portion of the sliver can and the can manipulating assembly includes means for moving the gripping elements to respective circumferentially spaced positions radially inwardly of and below the upper bead of a sliver can.

5. Apparatus for transporting full sliver cans according to claim 4 wherein the can manipulating assembly includes a plurality of centering elements mounted to the frame and positioned at respective circumferential spacings from one another relative to a circle generally concentric with a sliver can to be gripped for axially centering a gripped sliver can as it is lifted by the gripping elements.

6. Apparatus for transporting full sliver cans according to claim 4 wherein the can manipulating assembly includes means for extending the frame from a position in which the gripping elements are operable to release a sliver can onto the respective can support disposed at the can transfer location lying at a predetermined angular position relative to the direction of travel to a position laterally outward of the transport carriage for gripping a sliver can to be transferred to the transport carriage.

7. Apparatus for transporting full sliver cans according to claim 3 wherein the can manipulating assembly includes means for extending the frame laterally outwardly of the transport carriage on a side thereof opposite the one side to a position in which the gripping elements are operable to selectively grip a sliver can supported at a sliver can loading location or releasing of a gripped sliver can onto the sliver can loading location and for retraction of the frame to a position in which the gripping elements are operable to selectively grip a sliver can supported on a can support or to release a sliver can onto a can support.

8. Apparatus for transporting full sliver cans according to claim 7 wherein the can manipulating assembly is movable between a spinning station and the sliver can loading location.

9. Apparatus for transporting full sliver cans according to claim 1 wherein each spinning station includes means for signaling information relating to the filled status of silver cans from which sliver is drawn into the spinning stations and the can transport carriage includes means for controlling the can transport carriage to travel to a selected spinning station in response to a signal from the information signalling means indicating the need for a sliver can exchange operation at the selected spinning station.

10. Apparatus for transporting full sliver cans according to claim 1 wherein said sides and said ends form a generally equilateral hexagon.

* * * * *